US010174612B2

(12) United States Patent
Pimenov et al.

(10) Patent No.: US 10,174,612 B2
(45) Date of Patent: Jan. 8, 2019

(54) METHOD FOR DETERMINING A WATER INTAKE PROFILE IN AN INJECTION WELL

(71) Applicant: SCHLUMBERGER TECHNOLOGY CORPORATION, Sugar Land, TX (US)

(72) Inventors: Vyacheslav Pimenov, Moscow (RU); Valery Shako, Moscow (RU); Maria Sidorova, Moscow (RU); Bertrand Theuveny, Clamart (FR); George A. Brown, Southampton (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 60 days.

(21) Appl. No.: 14/973,968

(22) Filed: Dec. 18, 2015

(65) Prior Publication Data

US 2016/0177712 A1 Jun. 23, 2016

(30) Foreign Application Priority Data

Dec. 19, 2014 (RU) ..... 2014151469

(51) Int. Cl.
*E21B 49/00* (2006.01)
*E21B 47/06* (2012.01)
*E21B 47/10* (2012.01)

(52) U.S. Cl.
CPC ..... *E21B 49/008* (2013.01); *E21B 47/065* (2013.01); *E21B 47/1005* (2013.01)

(58) Field of Classification Search
CPC ..... E21B 47/06; E21B 49/008; E21B 47/065; E21B 47/1005; E21B 44/00; E21B 43/2408
See application file for complete search history.

(56) References Cited

U.S. PATENT DOCUMENTS 3,807,227 A 4/1974 Smith, Jr.
4,832,121 A * 5/1989 Anderson ..... E21B 43/26 166/250.09

(Continued)

FOREIGN PATENT DOCUMENTS

CA 2642589 A1 4/2009
RU 2125648 C1 1/1999
RU 2384698 C1 3/2010

OTHER PUBLICATIONS

Hasan, a.R., "Fluid Flow and Heat Transfer in Wellbores", Society of Petroleum Engineers, Richardson, Texas, 2002, p. 70.

(Continued)

*Primary Examiner* — Yong-Suk Ro

(57) ABSTRACT

A first water injection into an injection well is carried out followed by a first shut-in of the injection well. A second water injection is carried out, a volume of the injected water exceeds several times a volume of water in the well in an intake interval. Then there is a second shut-in of the injection well, and during the second shut-in transient temperature profiles are registered within the intake interval by temperature sensors. Then a third water injection step is carried out and at an initial stage of the third injection transient temperature profiles in the intake interval are registered using the temperature sensors. The transient temperature profiles registered during the second shut-in period are analyzed and intake zone boundaries are determined. The transient temperature profiles registered at the initial stage of the third water injection are analyzed and a water intake profile is determined.

5 Claims, 14 Drawing Sheets

(56) References Cited

U.S. PATENT DOCUMENTS

| | | | | |
|---|---|---|---|---|
| 7,536,905 | B2 * | 5/2009 | Jalali | E21B 47/065 702/12 |
| 8,146,656 | B2 * | 4/2012 | Brown | E21B 47/065 166/250.01 |
| 2005/0149264 | A1 * | 7/2005 | Tarvin | E21B 47/065 702/6 |

OTHER PUBLICATIONS

Niu, C. et al., "The Logging Technology for Determining Water-Intake Profile with the Radioisotopic Carriers", Spe 30873, Spe Advanced Technology, 5(1), 1997, pp. 106-110.

Poe, B. D. et al., "Determination of Multilayer Reservoir Inflow Profiles Using Pulsed Neutron Logs", Spe 94266 presented at the Spe Production and Operations Symposium, Oklahoma City, Ok, 2005, pp. 1-5.

Smith, R. C. et al., "Interpretation of Temperature Profiles in Water-Injection Wells", Spe 4649, Journal of Petroleum Technology, 1975, pp. 777-784.

Ramazanov, a. Sh. et al., "Thermal Modeling for Characterization of Near Wellbore Zone and Zonal Allocation", Spe 136256 presented at the Spe Russian Oil & Gas Technical Conference and Exhibition, Moscow, Russia, 2010, pp. 1-22.

* cited by examiner

METHOD FOR DETERMINING A WATER INTAKE PROFILE IN AN INJECTION WELL

CROSS-REFERENCE TO RELATED APPLICATION

This application claims priority to Russian Application No. 2014151469, filed Dec. 19, 2014 and which is incorporated herein by reference in its entirety.

FIELD

Example embodiments of the invention relates to geophysical exploration of oil and gas wells, in particular, to determining water intake profile in an injection well.

BACKGROUND

The water intake profile data are required for managing waterflooding process and, therefore, improvement of oil recovery factor. Determining a water intake profile means determining a relative proportion of the injected water which enters different intake zones. A combination of all intake zones forms a water intake interval of a well which had been perforated and penetrates within an oil and gas formation.

The most widespread method for determining a water intake profile in injection wells is a continuous flow meter logging during fluid injection (see, for example, Ipatov A. I., Kremenetsky M. I. "Geophysical and hydrodynamic methods of hydrocarbon field development monitoring", Moscow, 2005, p. 108). Usually, mechanical flowmeters are used for this purpose. This method has such shortcomings as limitations imposed by well architecture, whereby logging is not always possible in an operating injection well.

There are other known methods for determining a water intake profile, such as radioisotope method, neutron logging, etc. As a rule, all these methods are complicated, expensive and are used rarely.

The first method for identifying water intake zones in injection wells was temperature survey after shutting down water injection (Nowak, T. J., 1953. The estimation of water injection profiles from temperature surveys. Petroleum transactions, Vol. 198, pp. 203-212).

It has been shown that temperature within water intake zones in a shut-in well relaxes significantly slower than temperatures above and below the water intake zones. Today, this method is widely used for determining water-intake zones boundaries.

Another known method for determining a water intake profile has been described in U.S. Pat. No. 8,146,656. This method involves shutting down water injection, repeated injection once water temperature in the well above a water-intake zone has increased due to heat exchange with surrounding rocks, and temperature monitoring during heated water moving along a water intake interval. According to this method, temperature front movements are used as a basis for determining a rate of water movement and, therefore, for determining water intake profile in the water intake zone.

One disadvantage of this invention is a low accuracy of determining the water intake profile caused by temperature front becoming too dispersed as it moves along the water intake interval. It is especially true for horizontal wells where length of water intake intervals can be 300-500 m and even more.

SUMMARY

The invention provides for improved accuracy of determining water intake profile using a transient temperature measurements in a well. The proposed method has no limitations associated with well architecture.

According to the proposed method a first water injection into an injection well is carried out followed by stopping the water injection. After a first shut-in of the injection well, a second water injection into the injection well is carried out, a volume of the injected water exceeds several times a volume of water in the well in a water intake interval. Then the injection is stopped and there is a second shut-in of the injection well, during the second shut-in transient temperature profiles are registered within the water intake interval by temperature sensors. Then a third water injection into the injection well is carried out and at an initial stage of the third injection transient temperature profiles in the intake interval are registered using the temperature sensors. The transient temperature profiles registered during the second shut-in period are analyzed and intake water zone boundaries are determined. The transient temperature profiles registered at the initial stage of the third water injection are analyzed and a water intake profile is determined.

Temperature can be registered by fiber optic temperature sensors or by a large number of point sensors.

The volume of water injected into the injection well during the second water injection exceeds the volume of water in the injection well in the water intake interval at least four times.

Duration of the first and/or the second shut-in is at least eight hours.

BRIEF DESCRIPTION OF DRAWINGS

Some example embodiments of the invention are illustrated in the drawings.

FIG. 10 shows an undisturbed temperature of the formation (geotherm), temperature at the end of the first injection, temperature at the end of the first shut-in, temperature at the end of the second injection and at the end of the second shut-in;

DETAILED DESCRIPTION

Temperature profile T(z,t) along a vertical injection well during water injection can be approximately described by formula (1):

$$T(z,t) = T_f(z) - \Gamma \cdot l(t) + [T_{in} - T_{f0} + \Gamma \cdot l(t)] \cdot e^{-\frac{z}{l(t)}} \tag{1}$$

where z—a distance from Earth surface, $T_{in}$—a temperature of injected water, $T_f(z)$—an undisturbed formation temperature $$T_f(z) = T_{f0} + \Gamma \cdot z \tag{2}$$

$T_{f0}$—a formation temperature at Earth surface, Γ—geothermal gradient, $$l(t) = \frac{c_p \cdot G}{\Lambda(t)} \tag{3}$$

$c_p$—specific heat of water, G—water mass flowrate, $$\Lambda(t) = 2\pi \cdot \left[\frac{2}{Nu} \cdot \frac{1}{\lambda_w} + \ln\left(\frac{r_w}{r_c}\right) \cdot \frac{1}{\lambda_c} + F(t) \cdot \frac{1}{\lambda_f}\right]^{-1} \tag{4}$$

$r_c$ and $r_w$—a water flow radius and a well radius, $\lambda_u$, $\lambda_f$—water and formation thermal conductivities, $\lambda_c$—effective heat conductivity of a medium between water and formation (tubing and cement), Nu—Nusselt number, which is defined by Prandtl number (Pr) and Reynolds number (Re)

$$Nu = 0.021 \cdot Re^{0.8} \cdot Pr^{0.43} \tag{5}$$

$$Pr = \frac{c_p \cdot \mu_w}{\lambda_w} \tag{6}$$

$$Re = \frac{\rho_w \cdot V \cdot 2 \cdot r_c}{\mu_w} = \frac{2 \cdot G}{\pi \cdot r_c \cdot \mu_w} \tag{7}$$

where $\rho_w$ and $\mu_w$—water density and viscosity $$F(t) \approx \ln\left(1 + 1.3 \cdot \sqrt{\frac{a_f \cdot t}{r_w^2}}\right) \tag{8}$$

where $a_f$—formation thermal diffusivity.

Figure 1:
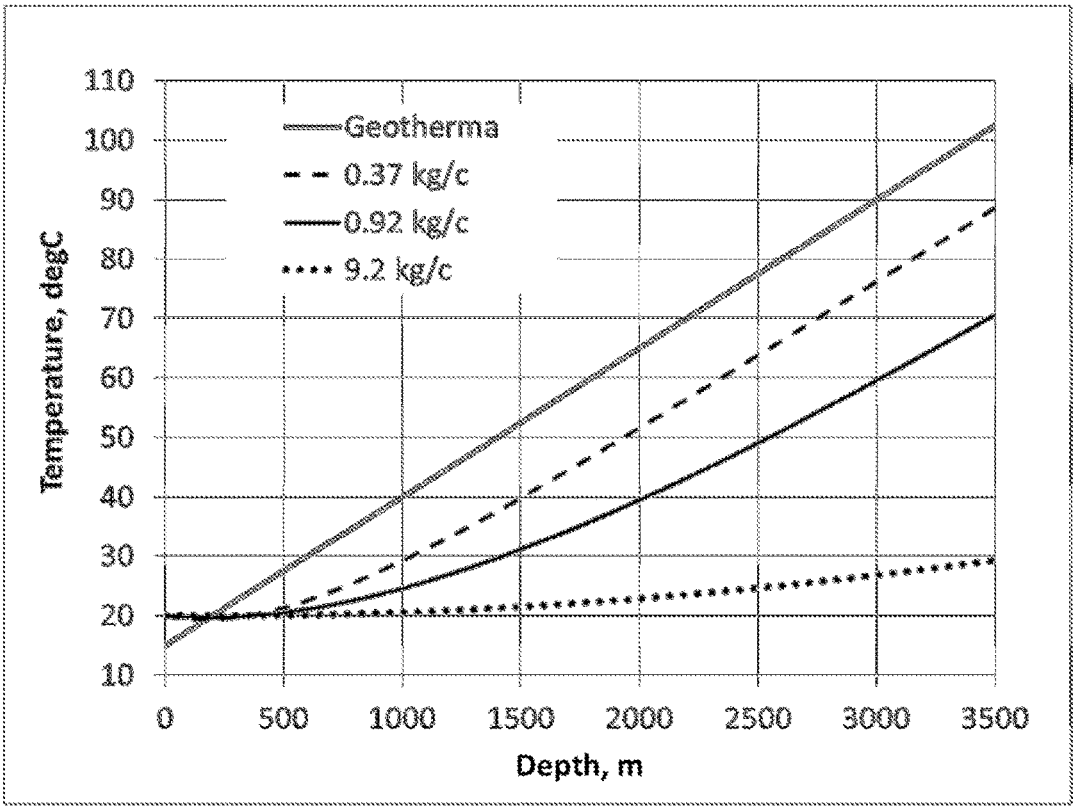
FIG. 1 shows temperature of a formation (double line) and water temperature profile in the well during injection for several flow rates.

FIG. 1 shows formation temperature (double line) and water temperature profiles in the well during the injection for different injection rates. Calculations were performed for the following parameters: $r_c$=0.1 m, $r_w$=0.15 m, well depth 3500 m, Γ=0.025 K/m, $a_f=10^{-6}$ m²/d, $\lambda_c$=1.2 W/m/K, $\lambda_f$=2.5 W/m/K, $T_{f0}$=15° C., $T_{inj}$=20° C., injection duration $t_{inj}$=1 year.

According to FIG. 1, for a conventional water injection rate (G>10 kg/s) after ~1 year of injection water temperature near the well bottom at 3500 m is about 60-80 K less than temperature of formation surrounding the well.

During water injection, a radial temperature profile in the formation outside water intake zones (in an impermeable bed, outside the perforated zones) is determined by conductive heat transfer. Assuming that wellbore wall temperature is approximately constant during water injection, the following formula for temperature radial profile in the formation can be obtained (9), (10):

$$T(r, t_{inj}) = T_f - (T_f - T_{inj}) \cdot \varphi(r, t_{inj}) \tag{9}$$

$$\varphi(r, t_{inj}) = \begin{cases} 1 & r \le r_c \\ 1 - \dfrac{\ln(r/r_c)}{\ln\left(1 + D \cdot \sqrt{a_f \cdot t_{inj}/r_c^2}\right)} & r_c < r < r_c + D \cdot \sqrt{a_f \cdot t_{inj}} \\ 0 & \text{otherwise} \end{cases} \tag{10}$$

where $T_f$—a formation temperature at the given depth, $T_{inj}$—wellbore wall temperature during water injection, D=1.7—A dimensionless constant that can be found from a comparison with numeric simulation results.

Formula (10) is obtained with the assumption that there is a quasi-stationary temperature profile between the water flow radius ($r_c$) and a moving external boundary $r_a(t_{inj})$ ($r_a t_{inj}$)=$r_c$+D·$\sqrt{a_f t_{inj}}$). The temperature at a flow boundary is equal to $T_{inj}$; at the external boundary and at great distances from the wellbore axis it is equal to the undisturbed formation temperature.

Figure 2:
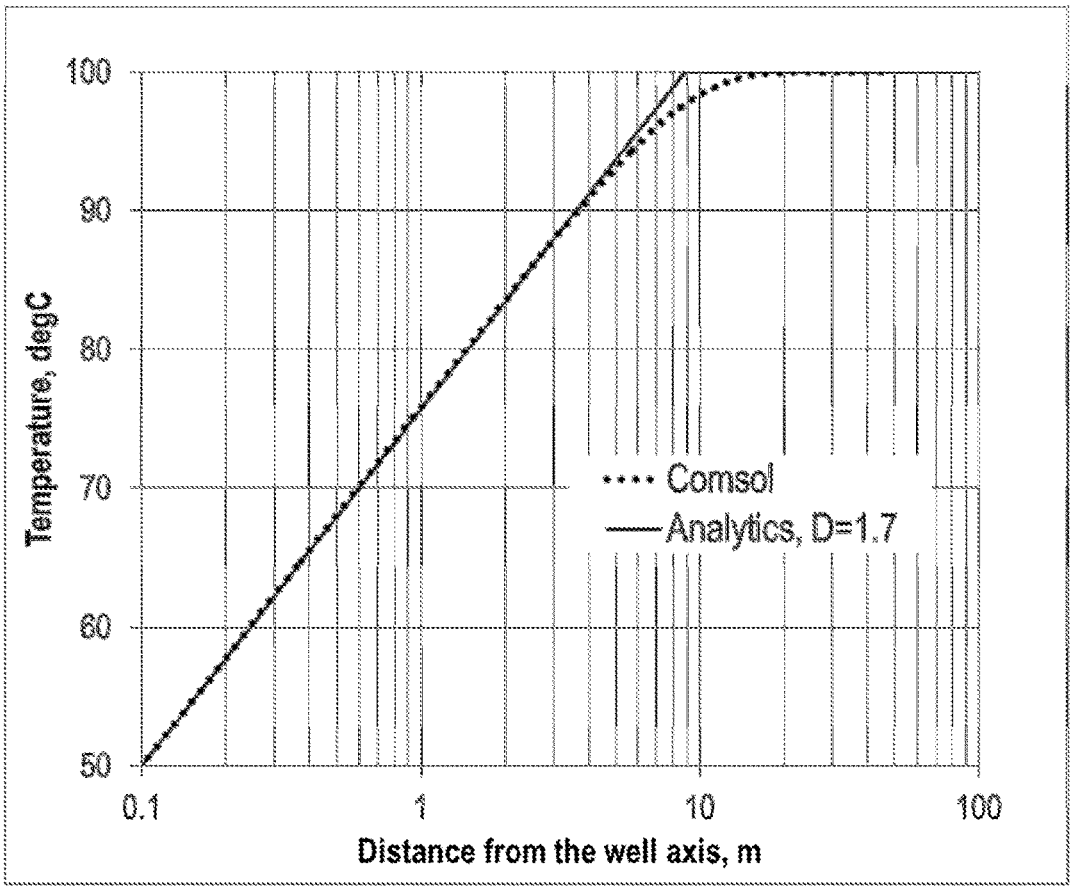
FIG. 2 shows a radial temperature profile in the well.

Correctness of formulas (9), (10) has been confirmed by commercial simulation software COMSOL Multiphysics®. FIG. 2 shows radial temperature profile calculated by formulas (9), (10) and a result of numerical simulation by COMSOL Multiphysics®. Calculations were performed for the following parameters: $T_f$=100° C., $T_w$=50° C., $a_f=0.8443 \cdot 10^{-6}$ m²/s, $t_{inj}$=1 year, D=1.7.

The radial temperature profile (9), (10) in the formation at the end of the injection was used as an initial temperature distribution for calculating dynamics of temperature change in the well when the injection was stopped. According to a general solution for a homogeneous medium, dependence of well center temperature on shut-in time can be approximately described by formulas (11), (12):

$$T_c(t_{sh}) = T_f - (T_f - T_{inj}) \cdot \psi(t_{sh}, t_{inj}) \tag{11}$$

$$\psi(t_{sh}, t_{inj,}) = \frac{1}{2 \cdot a_f \cdot t_{sh}} \cdot \int_0^\infty \exp\left(-\frac{r^2}{4 \cdot a_f \cdot t_{sh}}\right) \cdot r \cdot \varphi(r, t_{inj,}) dr \tag{12}$$

Figure 3:
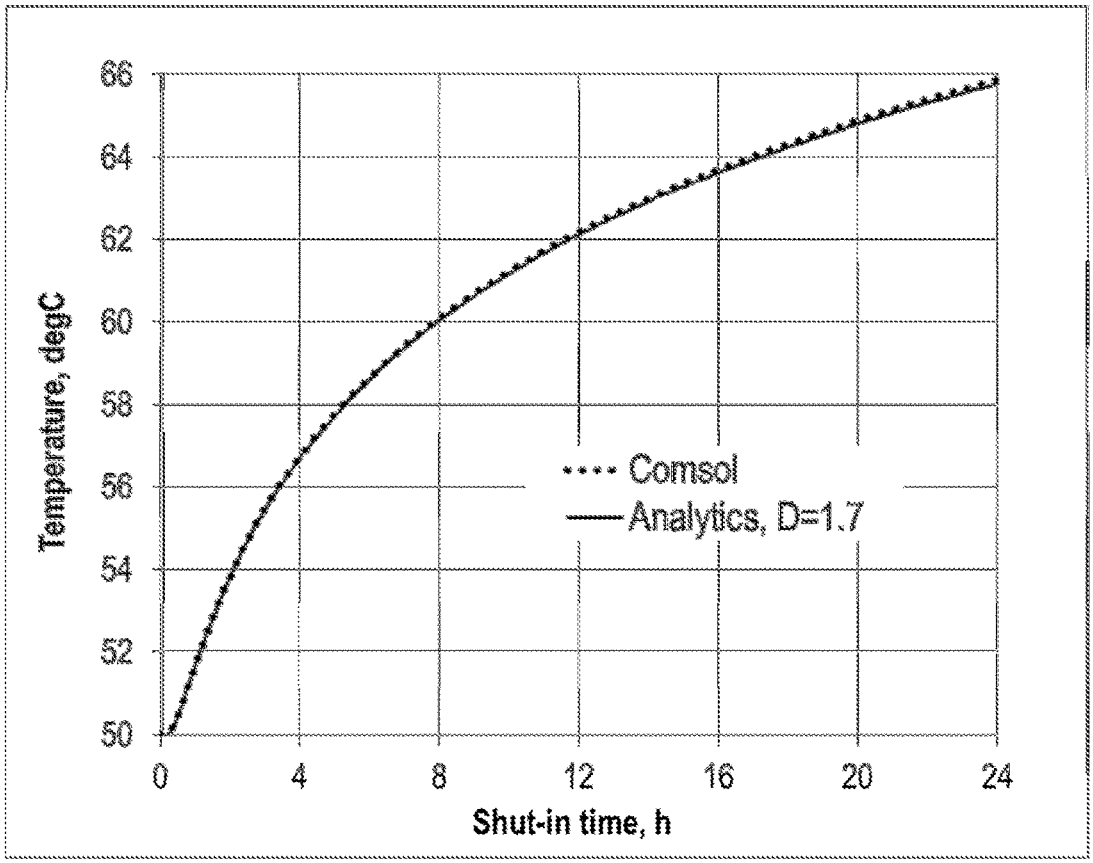
FIG. 3 shows a change in temperature in the shut-in injection well for the initial temperature profile shown on FIG. 2.

FIG. 3 shows temperature $T_c(t_{sh})$, calculated by formulas (11), (12) for the initial temperature profile shown on FIG. 2. The analytical solution (solid line) correlates well with the result of numerical simulation (COMSOL Multiphysics®, markers).

Formulas (11), (12) were used for analyzing an initial stage of temperature recovery in the injection well above the water intake zone.

Figure 4:
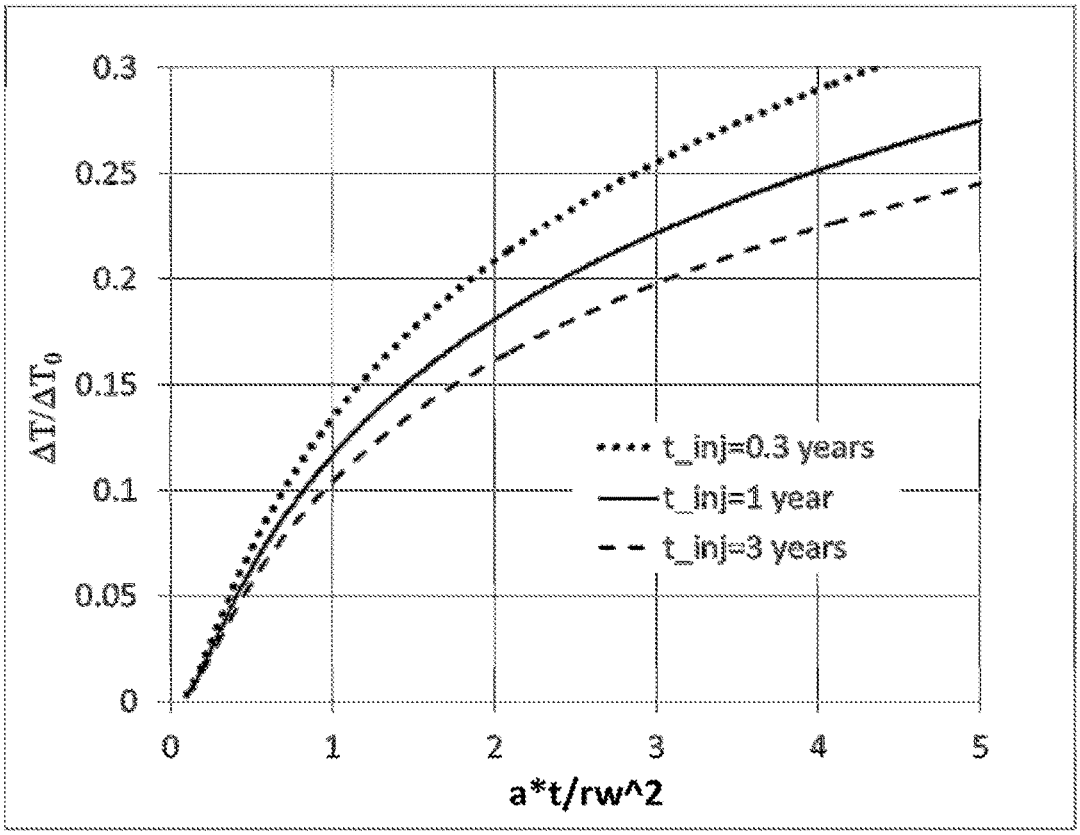
FIG. 4 shows a dependence of dimensionless temperature change in the well on dimensionless shut-in period for different durations of water injection.

FIG. 4 shows ratio of temperature change ΔT in a shut-in well to $\Delta T_0$ (difference between the formation temperature and the wellbore wall temperature during injection) as a function of dimensionless well shut-in time $a_f \cdot t_{sh}/r_c^2$:

$$\frac{\Delta T}{\Delta T_0} = 1 - \psi(t_{sh}, t_{inj,}),$$

According to FIG. 4, duration of a shut-in, during which 25% temperature recovery takes place ($t_{0.25}$), slightly depends on injection duration. It is determined mostly by the flow radius $r_c$ and formation thermal diffusivity $a_f$:

$$t_{0.25} \approx (3 \div 5) \cdot \frac{r_c^2}{a_f} \text{ or } t_{0.25} \approx 10 \div 15 \text{ hours}$$

Thus, for example, if during water injection a difference between injected water temperature at the bottomhole and formation temperature is 70 K, then in ~10-15 hours after the injection had stopped water temperature in the well above the injection zone (in an impermeable bed, outside the perforated zone) would be 15-20 K more than the temperature of the water injected in the formation.

For a cylindrical symmetric 1D model, a radius of the external boundary of a formation area filled with the injected water is defined by an obvious formula:

$$r_q(t_{inj}) = \sqrt{r_c^2 + \frac{1}{\phi} \cdot \frac{q}{\pi} \cdot t_{inj}} \tag{13}$$

where ϕ—formation porosity, q [$m^3$/m/s]—a specific flow rate of the injected water.

A radial temperature profile in the formation during water injection is determined with equation (14), which accounts for conductive and convective heat transfer into a porous medium:

$$\rho c \cdot \frac{\partial T}{\partial t} + \frac{1}{r} \cdot \frac{\partial}{\partial r}\left[r \cdot \left(-\lambda \cdot \frac{\partial T}{\partial r} + (\rho c)_{fl} \cdot V \cdot T\right)\right] = 0 \tag{14}$$

where:

$$\rho c = \phi \cdot (\rho c)_{fl} + (1 - \phi) \cdot (\rho c)_m, \tag{15}$$

volumetric heat capacity of fluid-saturated formation, $(\rho c)_{fl}$—volumetric heat capacity of water, $(\rho c)_m$—volumetric heat capacity of the rock matrix.

Accounting that a fluid filtration velocity V is determined by a specific injection rate q:

$$V = \frac{q}{2\pi \cdot r},$$

the equation (14) can be written as:

$$\frac{\partial T}{\partial t} + \frac{1}{r} \cdot \frac{\partial}{\partial r}\left[r \cdot \left(-a_f \cdot \frac{\partial T}{\partial r} + u \cdot T\right)\right] = 0 \tag{16}$$

where:

$$a = \frac{\lambda}{\rho c}, u = \chi \cdot \frac{q}{2\pi \cdot r}, \chi = \frac{(\rho c)_{fl}}{\rho c} = \frac{1}{\phi + (1 - \phi) \cdot \frac{(\rho c)_m}{(\rho c)_{fl}}} \tag{17}$$

The equation (16) is used below for a numeric solution of the direct problem with commercial simulation software COMSOL Multiphysics®.

For solution of the inverse problem (defining injection profile by temperature data) we have used an approximated analytical model based on simplified equation for temperature (18). This equation does not account for effects of heat transfer by conduction on temperature during water injection into the formation.

$$\frac{\partial T}{\partial t} + \chi \cdot \frac{q}{\pi} \cdot \frac{\partial T}{\partial r^2} = 0 \tag{18}$$

A general solution of this equation is:

$$T = T\left(r^2 - \chi \cdot \frac{q}{\pi} \cdot t\right) \tag{19}$$

Considering that the water injected into the formation has a relatively constant temperature $T_{inj}$, solution (19) means that during the water injection a cylindrical area is formed in the formation with a radius $r_T$ (20), in which temperature is equal to $T_{inj}$. Temperature outside this area is equal to the initial formation temperature $T_f$:

$$T(r, t_{inj}) = \begin{cases} T_{inj} & r < rT(t_{inj}) \\ T_f & \text{otherwise} \end{cases} \tag{20}$$

$$r_T(t_{inj}) = \sqrt{r_c^2 + \chi \cdot \frac{q}{\pi} \cdot t_{inj}} = \sqrt{r_c^2 + \frac{1}{\phi + (1 - \phi) \cdot \frac{(\rho c)_m}{(\rho c)_{fl}}} \cdot \frac{q}{\pi} \cdot t_{inj}}$$

Comparison of formulas (13) and (20) shows that the radius $r_T$ is always smaller that the radius $r_q$ of the formation area filled with injected water.

Figure 5:
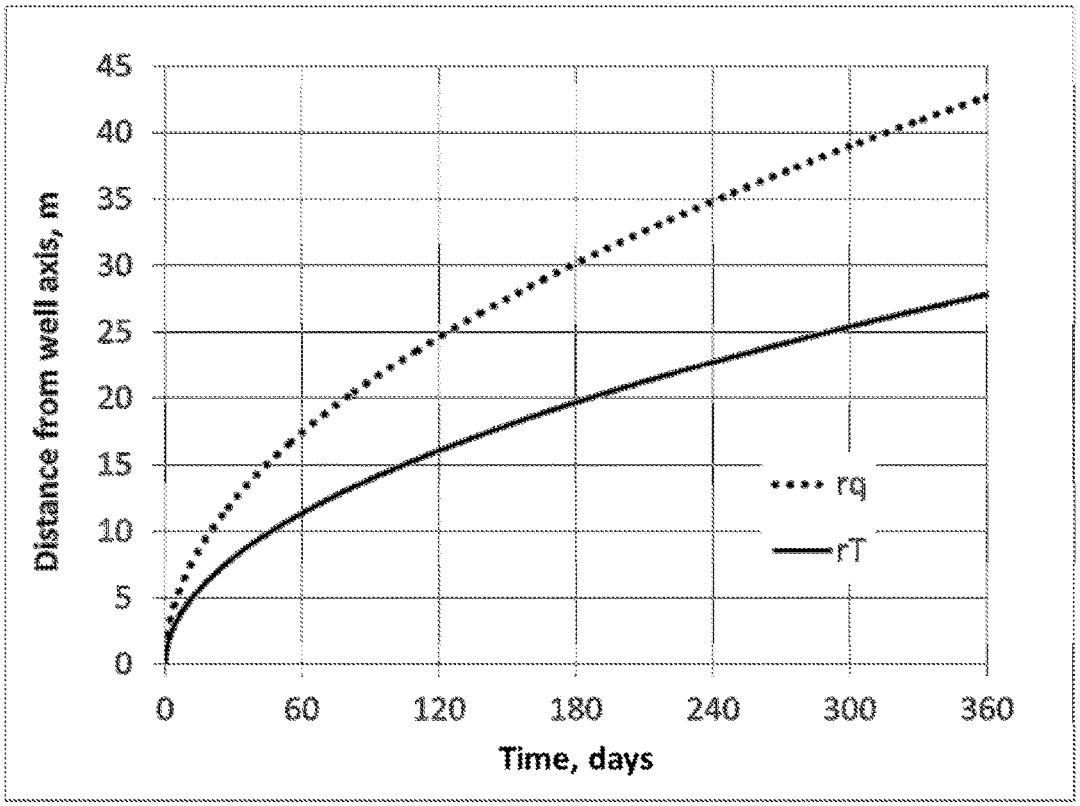
FIG. 5 shows a dependence of a radius of the formation filled with injection water and of a radius of an area where formation temperature is equal to the injected water temperature on a duration of water injection.

FIG. 5 shows how radiuses $r_q(t_{inj})$ and $r_T(t_{inj})$ are changing with time $t_{inj}$. Calculations have been made using the following parameters: injection rate $Q_0$=240 $m^3$/day/500, injection zone length L=50 m (specific flow rate q≈4.8 $m^3$/m/day), ϕ=0.3, $(\rho c)_m$=2700*900 J/$m^3$/K, $(\rho c)_w$=1000*4200 J/$m^3$/K.

Figure 6:
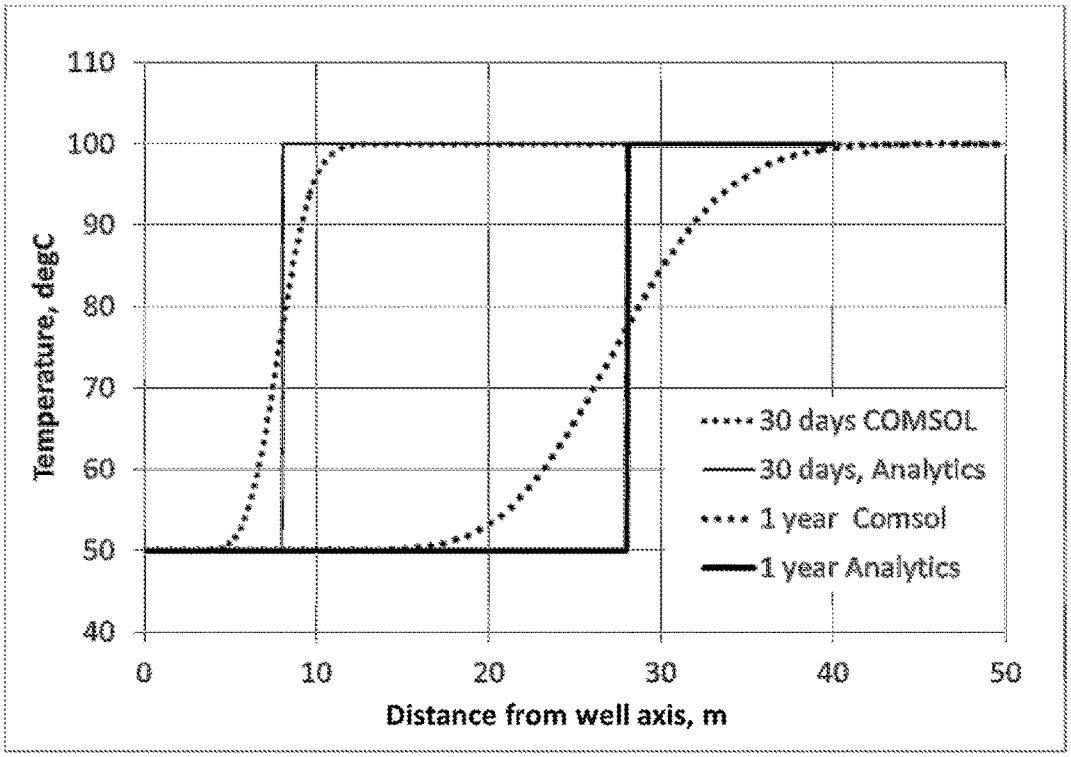
FIG. 6 shows a comparison of an analytical solution for a simplified problem of temperature profile in the formation during water injection with a numerical solution for a complete problem.

FIG. 6 shows the effect of conductive heat transfer on radial temperature profile in the formation during water injection. Temperature profiles shown by solid lines were obtained by COMSOL Multiphysics® as result of solving the general equation (16), profiles shown by dotted lines represent an analytical solution (20) of the equation (18). Calculations are made for $T_f$=100 degC, $T_{inj}$=50 degC, q=4.8 $m^3$/m/day and rock thermal conductivity of 2 W/m/K, for injection time 30 days and 1 year. As is clear from FIG. 6, conductive heat transfer makes stepped temperature profile smoother. This profile represents a solution of the simplified problem, although movement of the temperature front correlates well with the analytical solution (20).

According to the formula (20), after the end of water injection, a formation area around the wellbore with radius $r_T(t_{inj})$ has temperature $T_{inj}$, which is by tens of degrees less than the temperature of the formation surrounding the wellbore. The temperature in this area begins to restore by heat transfer from hotter rocks. For an approximate description of temperature recovery dynamics in the axis of this area (i.e.

in the wellbore), one can use known relations (21), (22), which can be applied for a case of a uniform medium (in terms of heat properties).

$$T_w(t_{sh}) = T_f - (T_f - T_{inj}) \cdot \psi_a(t_{sh}, t_{inj}) \tag{21}$$

$$\psi_a(t_{sh}, t_{inj}) = 1 - \exp\left[-\frac{c \cdot r_T(t_{inj})^2}{4 \cdot a_f \cdot t_{sh}}\right] \tag{22}$$

where $t_{inj}$—a duration of water injection before shut-in, $t_{sh}$—a duration of the shut-in, c—a dimensionless constant which is equal to 1 in case of stepped temperature profile in the formation in the beginning of the shut-in.

Figure 7:
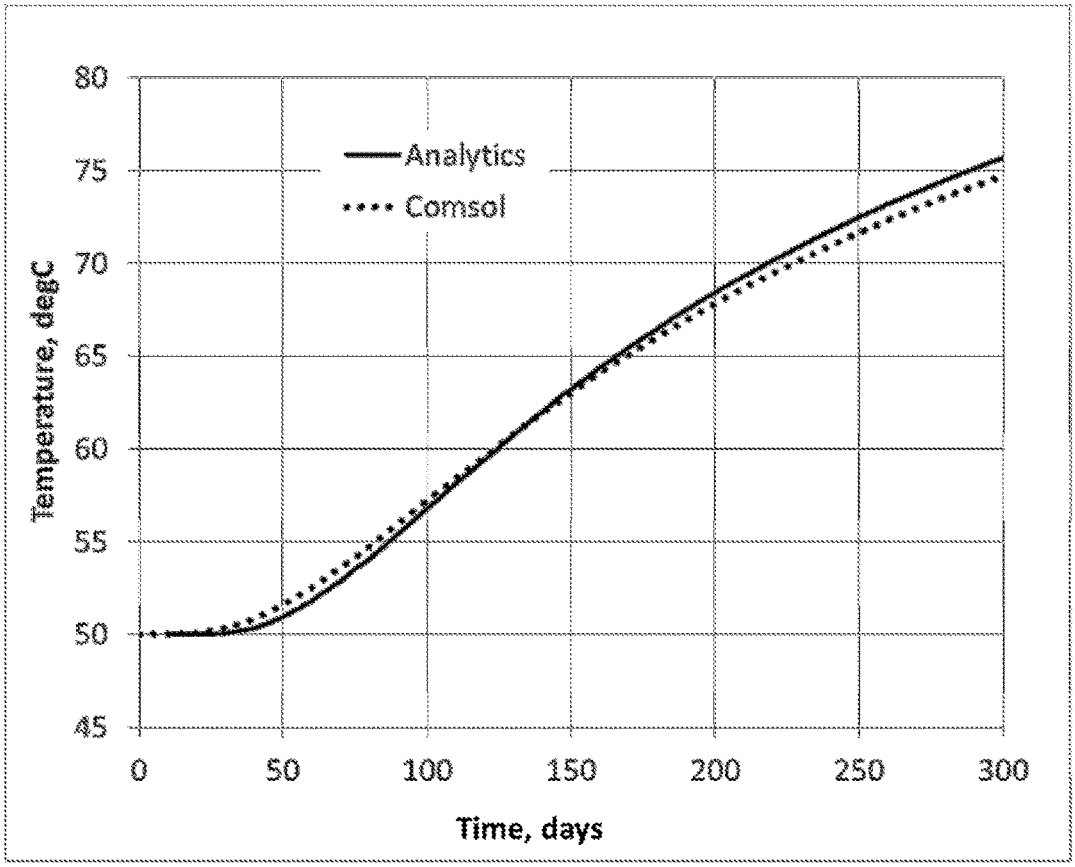
FIG. 7 shows a comparison of analytical and numerical solutions for temperature recovery in the well after water injection.

As it is seen from FIG. 6, temperature profile in the formation for longer injection times differs significantly from a stepped profile; nonetheless, the formula (22) with constant c=0.95 agrees well with the results of numeric simulation with COMSOL Multiphysics® (FIG. 7, q=4.8 $m^3$/m/day, $t_{inj}$=30 day). Further, analytical relations (21), (22) are used for interpreting the temperature data.

Figure 8:
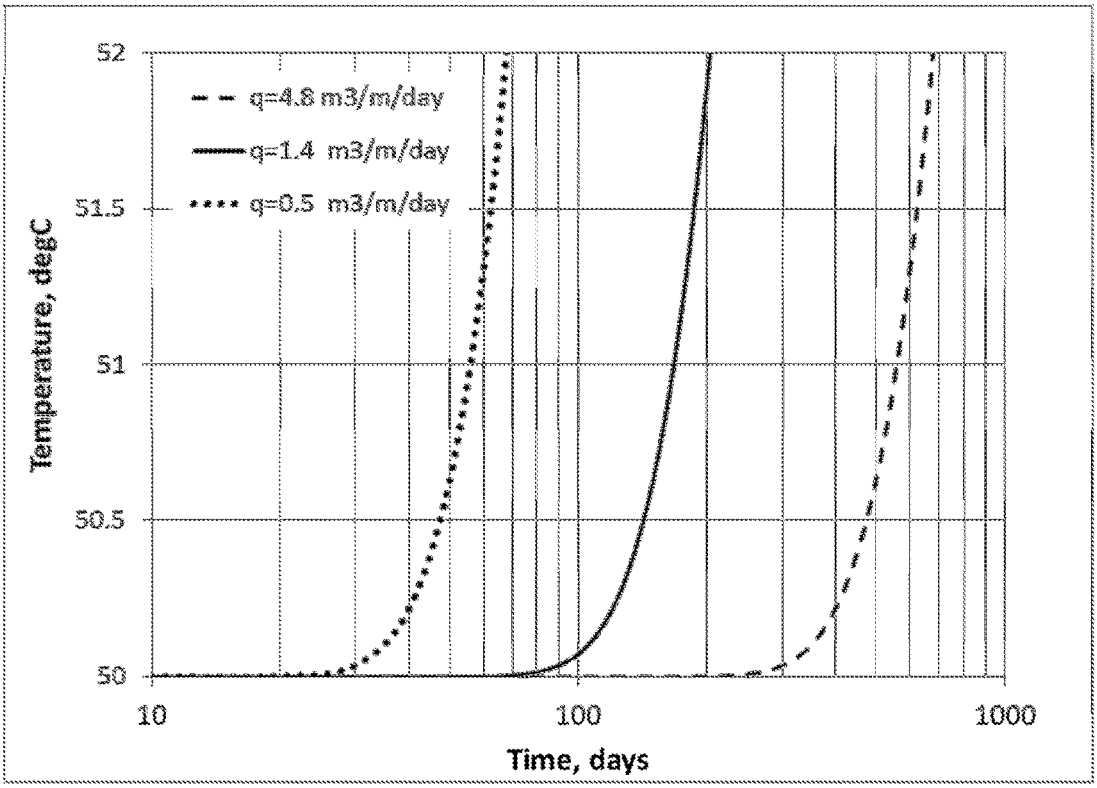
FIG. 8 shows dynamics of temperature recovery in the well after water injection during 300 days.

FIG. 8 shows calculated dynamics of temperature recovery in a well after water injection during 300 days. Calculations are made by the formulas (21), (22) for specific flow rates q=0.5, 1.4 and 4.8 $m^3$/m/day. As the FIG. 8 shows, with specific water injection flow rate q=4.8 $m^3$/m/day the temperature in the well after injection remains practically constant during 300 days; even with specific water injection rate 0.5 $m^3$/m/day the temperature in the well practically does not change during 30 days. It means that after a long period of water injection with bottomhole temperature $t_{inj1}$, formation temperature near the injection well remains close to $t_{inj1}$ many days after the injection. It is fair for all intake zones, regardless of their permeability, skin effect and, therefore, value q, unless specific injection flow rate in some zone happens to be tens of times less than the average flow rate q across the entire intake interval.

As is shown above, the water which is in the well above the intake interval is warming up quickly due to heat transfer from hot rocks surrounding the wellbore, and after approximately 12 hours of well shut-in, temperature of this water $t_{inj2}$ will be much higher (by 10-20 K) than the temperature of the formation $t_{inj1}$ near the wellbore in the intake interval.

During the next injection of this water into the formation, different radial temperature profiles occur in different intake zones (different values $r_T$). It is caused by the fact that specific water injection rates q depend on skin factors and permeabilities of these zones.

According to the formulas (21), (22) the rate of temperature recovery in the well after injection depends on the radius $r_T$. If a relatively small volume of water is injected into the formation, then the heated zone radius $r_T$ exceeds the wellbore radius only a few times, then the characteristic temperature recovery time is relatively short (10-20 hours). In this case, the dependency between $r_T$ (and q) and the temperature recovery rate can be used for determining water injection profile based on temperature distributions measured in the well across the intake interval at different times after the injection.

There is an optimum volume of water which, when injected into the well, would provide the best correlation between the shut-in temperature profile and the injection profile. If a volume of water injected into the well is less than a volume of water in the well within the intake interval, then in all intake zones the heated area radius $r_T$ will be close to the well radius and the temperature in the well after shut-in will depend very little on the injection profile. Conversely, if the volume of water injected into the well is much greater than the volume of water in the well within the intake interval, then a detectable correlation between the downhole temperature and injection profile will only appear 24 hours or longer after the injection, which is not convenient from an operational standpoint. Calculations show that the optimum volume of water injected into the well is the volume which is at least three to five times (four times, preferably) greater than the volume of water in the well in the intake interval.

It should be noted that quantification of the injection profile is only possible if no cross-flows exist in the wellbore (between different intake zones) during the well shut-in period. Otherwise, if data demonstrate the presence of cross-flows, temperature survey data from a shut-in well can only be used for an approximate estimation of the injection profile.

In case of a long (100 m and more) intake interval, quantification of the injection profile can be made possible by numerical simulation of the well-rock-formation system, because temperature of water coming into different intake zones is not constant, so the simplified model indicated above is not applicable.

An important result that can be obtained directly from temperature profile in a shut-in well is the capability to identify intake zones with different flow rates 'q'. These zones correspond to wellbore areas with approximately constant temperature values.

Information about intake zone boundaries is used as shown below to determine injection profile based on analysis of temperature profile movement during the next water injection step.

After a first long-lasting injection and a first shut-in period that lasts at least eight hours (in average, for 12 hours), and a second short injection (with a volume of injected water equal to 4 well volumes in an intake interval) and a second shut-in period of at least eight hours (in average, for 12 hours), a temperature profile in the intake interval begins to correlate much better with the injection profile.

It is essential for the proposed injection profile determination method that water temperature in the intake interval would vary substantially along the wellbore, i.e. that water temperature is not constant.

Figure 9:
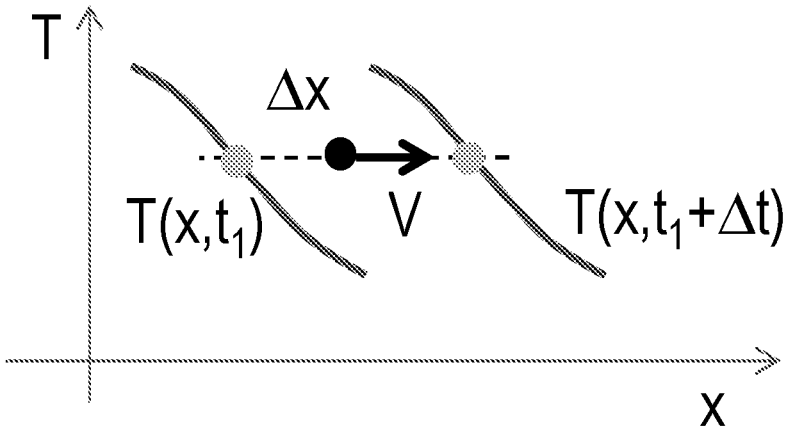
FIG. 9 shows a schematic illustrating a shift in temperature profile during the water injection.

Injection of water in the well results in movement of the water filling the wellbore across the intake interval and, therefore, to a shift in the established temperature profile. Value of the temperature profile shift Δx is determined by a local velocity of water V(x) (FIG. 9):

$$\Delta x = V \cdot \Delta t \tag{23}$$

where:

$$V(x) = \frac{Q(x + 0.5 \cdot \Delta x)}{A(x + 0.5 \cdot \Delta x)}, \tag{24}$$

Q(x)—a local volumetric flow rate of e water flowing through the well, A(x)—a flow cross section, Δt—a time interval between the temperature profiles. For simplicity, it is further assumed that A=const.

Below is one method of processing transient temperature data for determining an injection profile.

A water intake interval includes several intake zones with different permeabilities and skin effects so that a water flow in each zone is equal to $Q_i$ [$M^3$/c] (i=1, 2, . . . m, m number of intake zones), $$Q_0 = \sum_i Q_i$$

full flow of water injected into the well.

In this case, a water injection profile is characterized by values $\{y_i\}$ of dimensionless water flow rates into different zones:

$$y_i = \frac{Q_i}{Q_0},\ 1 = \sum_i y_i. \tag{25}$$

Let $\{xb_i\}$(i=0, 1 . . . m) be coordinates of the intake zones, and $xb_0$ and $xb_m$ represent a beginning and an end of the water intake interval. These values can be obtained from geophysical surveys and geological studies of the well or from the above analysis of the temperature profiles measured in a shut-in well after a brief injection.

Let f(x) be a dimensionless temperature profile shift at a point with coordinate x:

$$\Delta x = \Delta x_1 \cdot f(x) \tag{26}$$

where $\Delta x_1$—shift of temperature profile at a point with coordinate $x_1$, which is located in a first intake zone ($xb_0 \le x < xb_1$).

Selection of this point is determined by two conditions. On one side, this point ($x_1$) should be as close as possible to the beginning of the intake interval ($xb_0$), on the other side, a distance from $xb_0$ should be so great that temperature measured at this point would not be affected by temperature profile in the warmed water which exists above the intake zone before the injection.

Considering that at the end of the intake interval ($x = xb_m$) water flow rate and value $\Delta x$ are equal to zero, and based on the assumption about constant flow rate $q_i$ of the injected water within each intake zone, the dimensionless temperature profile shift f(x) can be approximated by a piecewise-linear function that is fully defined by values $\{y_i\}$.

In case of three injection zones, this function is given by:

$$f(x, y_1, y_2) = \begin{cases} 1 - y_1 \cdot \dfrac{x_1 - xb_0}{xb_1 - xb_0} - \dfrac{x - x_1}{x_1 - xb_0} & x_1 < x < xb_1 \\ 1 - y_1 - y_2 \cdot \dfrac{x - xb_1}{xb_2 - xb_1} & xb_1 \le x < xb_2 \\ 1 - y_1 - y_2 - (1 - y_1 - y_2) \cdot \dfrac{x - xb_2}{xb_3 - xb_3} & xb_2 \le x < xb_3 \end{cases} \tag{27}$$

Here, unknown values are $y_1$ and $y_2$ ($y_3 = 1 - y_1 - y_2$). The values of dimensionless flow rates should be such that they meet the condition (28) for all values of the coordinate x:

$$T(x, t_1 + \Delta t) = T[x - \Delta x_1 \cdot f(x, y_1, y_2), t_1] \tag{28}$$

Considering possible errors in downhole temperature measurements and incomplete adequacy of the mathematical model used, more reliable results can be obtained if this condition is used in an integral form:

$$\int_{x_1 + \Delta x_1}^{xb_m} \{T(x, t_1 + \Delta t) - T[x - \Delta x_1 \cdot f(x, y_1, y_2), t_1]\}^2 dx \equiv S(y_1, y_2) \Rightarrow \min \tag{29}$$

Possibility of determining an intake profile using the proposed method is demonstrated on synthetic examples prepared with numeric simulation tool T-Mix, which is based on a completely non-stationary model of heat and mass transfer processes in a well, formation and rocks surrounding the wellbore ("Thermohydrodynamic surveys in well for determining formation near-wellbore zone properties and flow rates of a multiple-zone system". SPE 136256//Source book of the Russian Petroleum Conference and Exhibition, SPE, Russia. Moscow, 2010. p. 513-536).

Pressure distribution in a radially heterogeneous gas or oil (a single-phase model) formation is simulated numerically using Darcy law and equation of continuity. Downhole pressure distribution is calculated by the quasi-stationary law of conservation of momentum, which accounts for pressure loss caused by friction, flow acceleration and gravity. A completely non-stationary energy-conservation equation for energy in the formation accounts for conductive and convective heat transfer, adiabatic effect and Joule-Thomson effect. Energy equation for a downhole fluid stream accounts for mixing of fluid streams, heat transfer between the well and rocks, adiabatic effect and Joule-Thomson effect.

Let us consider a horizontal well with a length of a water intake interval L=300 m consisting of three intake zones of equal length ($L_1 = L_2 = L_3 = 100$ m, the last zone lies closer to the bottomhole). The intake zones are characterized by the following parameters: zero skin factors $s_1 = s_2 = s_3 = 0$, permeability $k_1 = 3$ mD, $k_2 = 9$ mD, $k_3 = 6$ mD, formation pressure $P_e = 370$ Bar, formation temperature $T_f = 111.5°$ C., surface temperature of injected water is equal to $T_{inj} = 20°$ C.

Properties of the injected fluid: density $\rho_w = 1000$ kg/m$^3$, thermal conductivity $\lambda_w = 0.65$ W/m/K, specific heat $c_w = 4200$ J/kg/K, viscosity $\mu_w = 0.5$ cP, compressibility $\beta_w = 4 \cdot 10^{-5}$ Bar$^{-1}$. Full length of the well is 4000 m, tubing shoe is at 3000 m, layers are at the 3700-4000 m interval, an internal radius of tubing $r_t = 0.0503$ m, an internal radius of casing string $r_c = 0.0808$ m.

Estimated dimensionless flow rates in different intake zones are equal to: $y_1 = 0.167$, $y_2 = 0.504$, $y_3 = 0.329$.

The proposed method for determining an intake profile is based on the optimum sequence of operations performed downhole, which in the case under consideration is modeled using T-Mix simulation software:

- The first operational water injection is carried out during $t_{inj1} = 92$ days with injection flow rate Q=2000 m$^3$/day,
- the first shut-in period lasts 12 hours,
- the second (brief) injection is carried out with injection flow rate Q=2000 m$^3$/day during $t_{inj2} = 0.5$ hour,
- the second shut-in period lasts 12 hours, and
- the third water injection is carried out with injection flow rate 200 m$^3$/day during $t_{inj3} = 0.5$ h.

Figure 10:
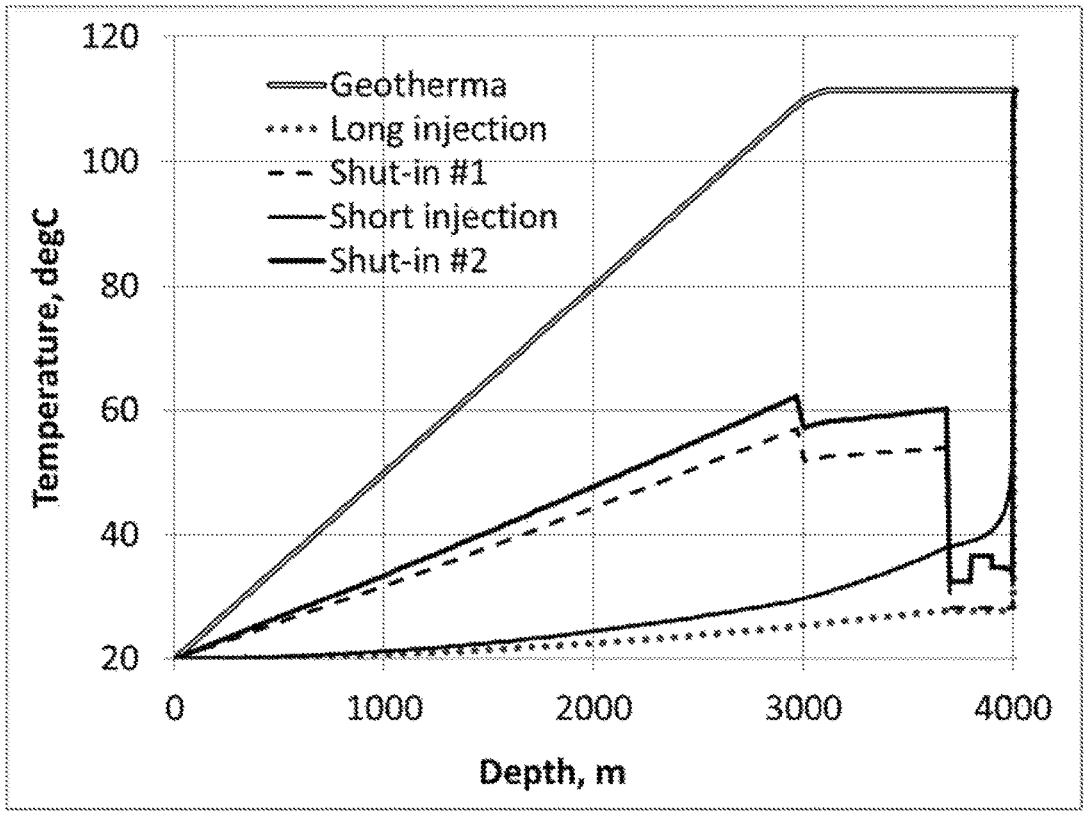

FIG. 10 shows a dependence of the following temperatures from the distance (measured along the wellbore): undisturbed rock temperature (double curve), temperature at the end of the first (long-lasting) injection (markers), temperature at the end of the first shut-in period (dotted line), at the end of the second (brief) injection (thin curve) and at the end of the second shut-in period (thick curve). A temperature spike at 3000 m depth corresponds to the tubing shoe.

Figure 11:
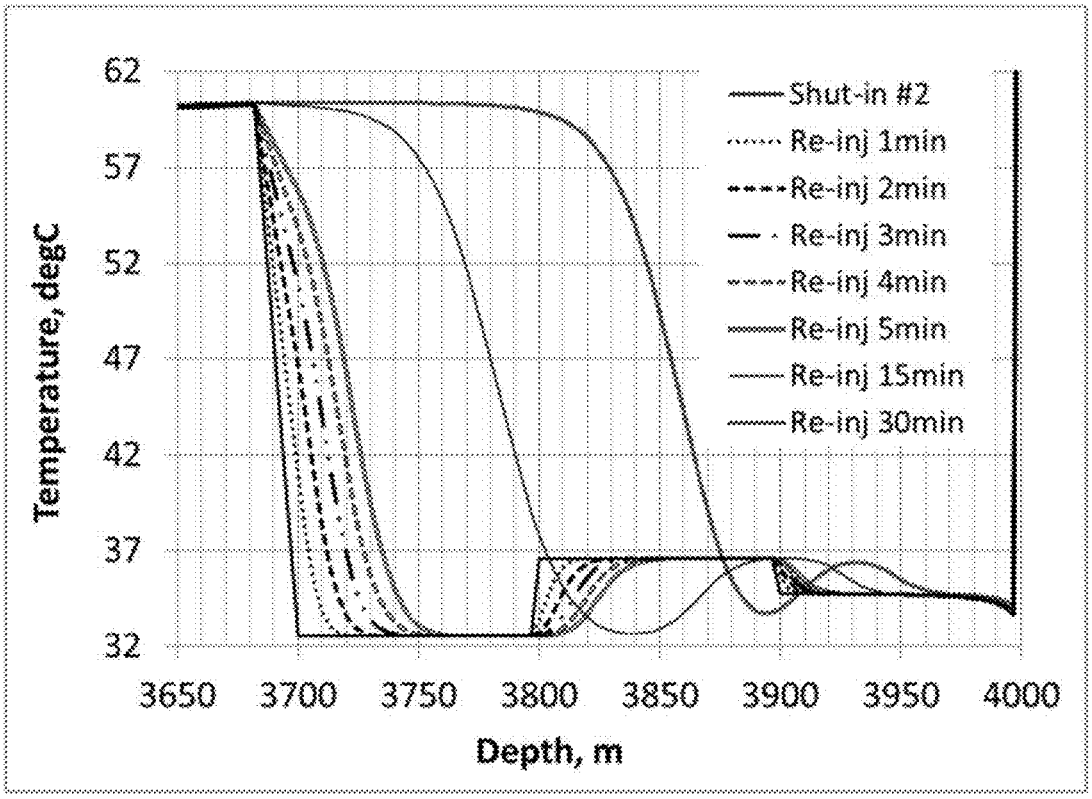
FIG. 11 shows a temperature profile before starting the last, third injection and estimated temperature profiles in 1, 2, 3, 4, 5, 15, 30 minutes after injection start.

FIG. 11 shows temperature before the beginning of the last (third) injection in the water intake interval (3700-4000 m) and estimated downhole temperature profiles in 1, 2, 3, 4, 5, 15, 30 minutes after the injection start.

FIG. 11 shows that downhole temperature is not constant at all before the beginning of the third injection step. According to the method proposed in this invention, temperature data can be used for identifying three intake zones. A relatively sharp change of temperature occurs at the boundaries of these zones, while within the zones temperature varies quite little.

Temperature above the intake interval is by ~27 K higher than that in the first intake zone (3700-3800 m), temperature in the second intake zone (3800-3900 m) is by ~4 K higher than in the first, temperature in the third intake zone (3900-4000 m) is by ~1.5 K less than in the second intake zone.

Movement of water in the well during injection causes temperature profiles to shift. Such shift is detected by temperature sensors installed downhole (for example, by fiberoptic temperature sensor or by a large number of point sensors).

To determine an intake profile, it is convenient to use temperature profiles at the initial stage of the last injection (i.e. first 3-5 minutes), when the temperature profile is the most distinct.

Figure 12:
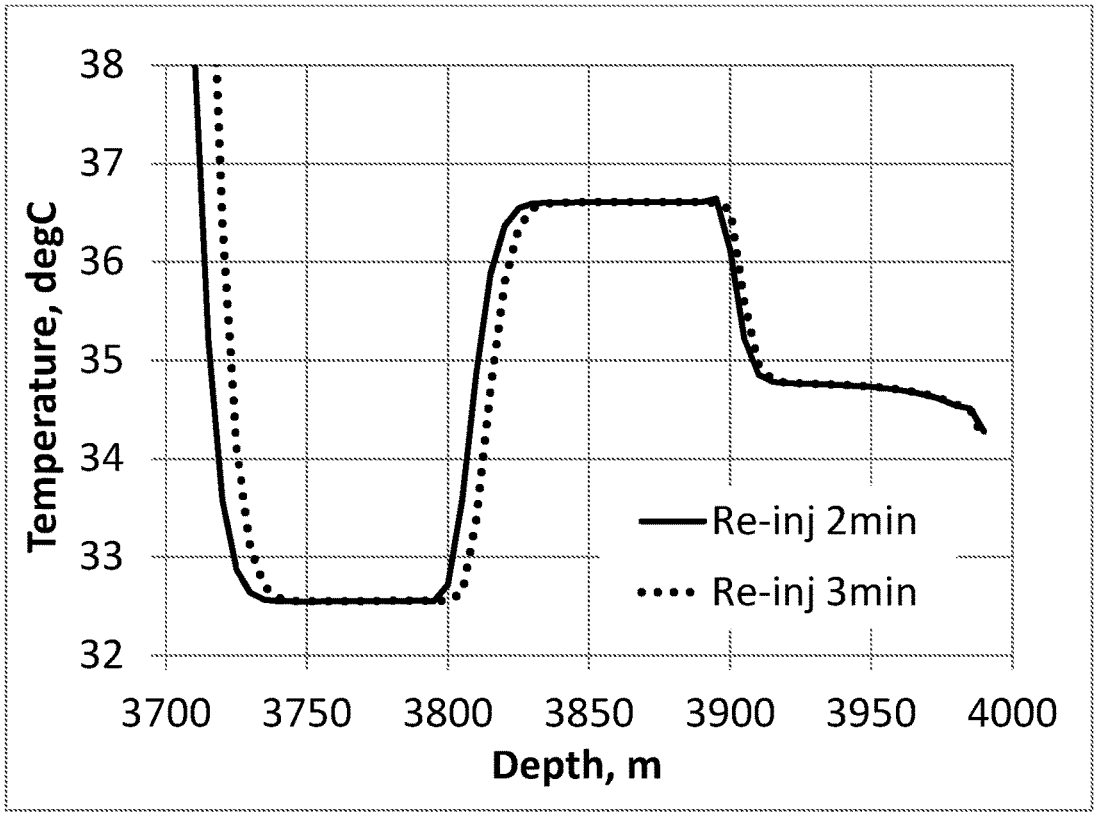
FIG. 12 shows temperature profiles calculated by T-Mix simulation.

FIG. 12 shows estimated temperature profiles representing the duration of the last injection step, 2 and 3 minutes.

According to the method described in this invention, the formulas (27)-(29) were used for making calculations which precisely estimate dimensionless injection flow rates based on the temperature profiles shown on FIG. 12: $y_1$=0.167, $y_2$=0.504, $y_3$=0.329.

Figure 13:
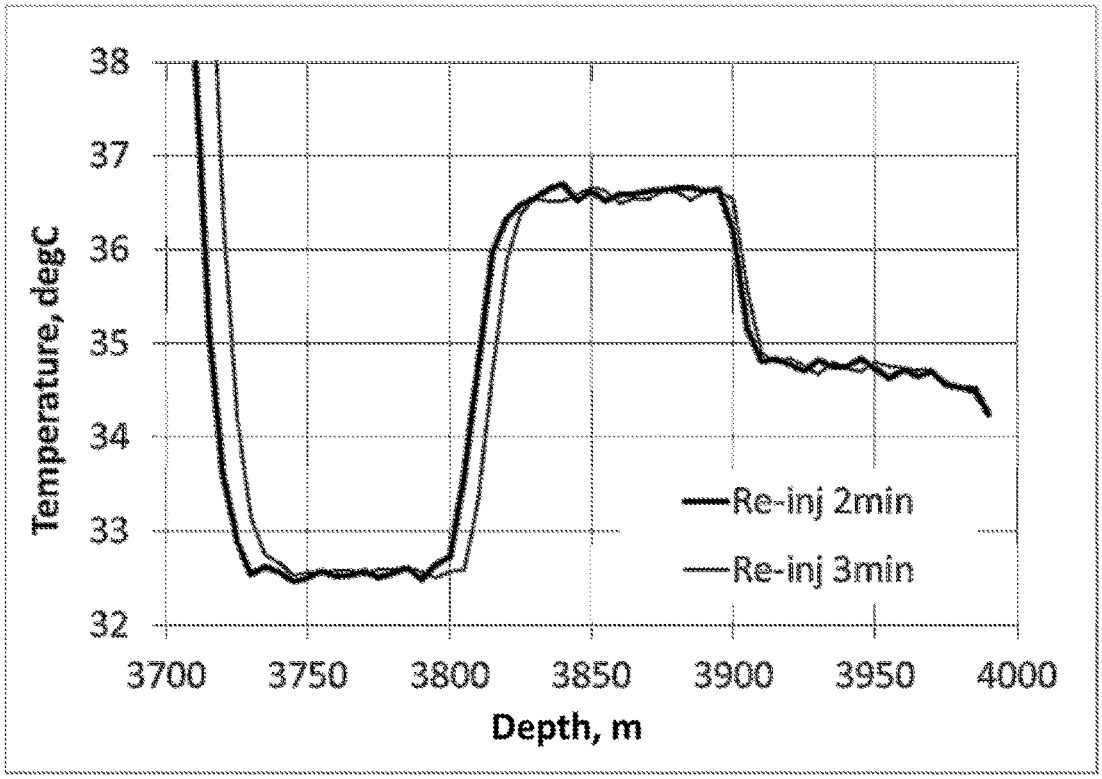
FIG. 13 shows noisy temperature profiles calculated by T-Mix simulation.

In order to estimate the effects of inevitable temperature measurement errors, random temperature variations uniformly distributed in the range from −0.1 K to 0.1 K were superimposed on estimated temperature distributions obtained with T-Mix (2 and 3 minute injections). The temperature profiles with superimposed noise are shown on FIG. 13.

From the solution of the inverse problem (29), the following values were found for the dimensionless flow rates: $y_1$=0.150, $y_2$=0.527, $y_3$=0.323 (exact solution $y_1$=0.167, $y_2$=0.504, $y_3$=0.329).

Figure 14:
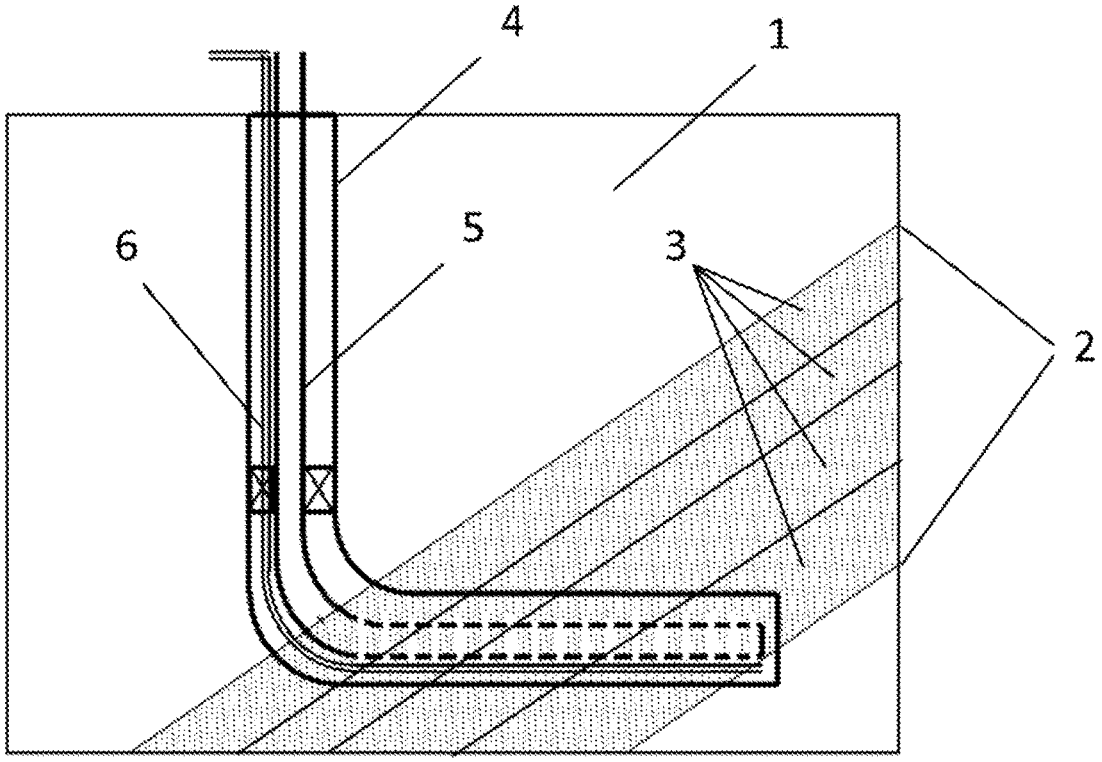
FIG. 14 shows a schematic view of an injection well with an intake interval formed of intake zones.

FIG. 14 is a general schematic view of a formation 1 penetrated by an injection well 4 having a water intake interval 2 formed by water intake zones 3. There is a tubing 5 inside the injection well 4 and temperature sensors, 6 for example fiberoptic temperature sensors, for registering transient temperature profiles within the water intake interval.

What is claimed is:

1. A method for determining a water intake profile in an injection well, the method comprising:

a first water injection into an injection well in a subterranean formation, stopping the first water injection into the injection well and carrying out a first shut-in of the injection well;

a second water injection into the injection well, wherein a volume of the injected water exceeds several times a volume of water in a water intake interval, wherein the water intake interval comprises a plurality of water intake zones;

stopping the second water injection into the injection well and carrying out a second shut-in of the injection well;

during the second shut-in transient temperature profiles are registered within the water intake interval by temperature sensors;

a third water injection into the injection well, at an initial stage of the third water injection transient temperature profiles are registered within the water intake interval by the temperature sensors;

analyzing the transient temperature profiles registered during the second shut-in of the injection well and determining boundaries of the plurality of water intake zones;

analyzing the transient temperature profiles registered at the initial stage of the third water injection into the injection well and determining the water intake profile.

2. The method of claim 1, wherein the temperature sensors are fiberoptic temperature sensors.

3. The method of claim 1, wherein the temperature sensors are point sensors.

4. The method of claim 1, wherein the volume of water injected into the injection well exceeds the volume of water in the injection well in the water intake interval at least four times.

5. The method of claim 1, wherein the duration of each shut-in of the injection well is at least eight hours.

* * * * *